United States Patent [19]

Chan

[11] Patent Number: 4,975,990

[45] Date of Patent: Dec. 11, 1990

[54] DISPOSABLE, SPLASH-SUPPRESSING TOILET SEAT COVER WITH FOLDED ANNULAR AND BRIDGING INNER PORTIONS

[76] Inventor: Paul S. Chan, P.O. Box 1232, Cupertino, Calif. 95014

[21] Appl. No.: 473,869

[22] Filed: Feb. 2, 1990

[51] Int. Cl.[5] ..... A47K 13/16

[52] U.S. Cl. ..... 4/243

[58] Field of Search ..... 4/243, 244–247

[56] References Cited

U.S. PATENT DOCUMENTS

| | | | |
|---|---|---|---|
| D. 174,213 | 3/1955 | Brito | 4/243 X |
| 746,111 | 12/1903 | Lauer | 4/243 |
| 1,236,798 | 8/1917 | White | 4/243 |
| 1,293,955 | 2/1919 | Sloan | 4/243 |
| 1,440,773 | 1/1923 | Dykstra | 4/243 |
| 1,505,067 | 8/1924 | Lahmer | 4/243 |
| 1,673,622 | 6/1928 | Engalitcheff | 4/243 |
| 1,835,787 | 12/1931 | Knisely | 4/243 |
| 4,352,214 | 10/1982 | Belz | 4/243 |
| 4,766,617 | 8/1988 | Thygesen et al. | 4/243 |

FOREIGN PATENT DOCUMENTS

| | | | |
|---|---|---|---|
| 330592 | 8/1989 | European Pat. Off. | 4/243 |
| 2737178 | 3/1979 | Fed. Rep. of Germany | 4/243 |
| 5601 | of 1906 | United Kingdom | 4/243 |
| 8801844 | 3/1988 | World Int. Prop. O. | 4/243 |

*Primary Examiner*—Henry J. Recla

*Assistant Examiner*—Robert M. Fetsuga

*Attorney, Agent, or Firm*—David Pressman

[57] ABSTRACT

A splash-suppressing toilet seat cover (10) made of a sheet of paper or other disposable folding material. The sheet is cut and folded so that an annular portion acts as a toilet seat cover (16) to prevent body contact with toilet seat (42). The center-cut portion hangs below the user's buttocks (40) and the rest of the seat cover and above the toilet water's surface so as to act as a splash-suppressing device (26). The splash-suppressing device (26) effectively reduces splashing of toilet water caused by the drop of stools into toilet water, and also blocks the splashes, when and if they occur, from contacting the human body. A zig-zag or fan-fold is provided at one end of the cover; this fan-fold extends across the center portion and its adjacent side portions. By unfolding the fan-folds of the center portion and leaving the fan-folds of adjacent portions folded, the center portion can effectively be made longer so that it can hang down below the side portions. Two openings are provided in the splash-suppressing device (26). One opening is formed by a pair of flaps (30) and (32) to slow down the speed of the stools so as to reduce the chance of creating a splash. The other opening is formed by a flap (36) which allows urine to drip onto the water surface (44) without contaminating the toilet's surrounding area; also it prevents the user's penis (46) from contacting the toilet seat (42).

19 Claims, 6 Drawing Sheets

DISPOSABLE, SPLASH-SUPPRESSING TOILET SEAT COVER WITH FOLDED ANNULAR AND BRIDGING INNER PORTIONS

BACKGROUND

1. Field of the Invention

The invention relates to toilet seat covers, specifically to such covers which are disposable and which afford enhanced protection to users.

2. Background -- Description of Prior Art

It is known that there is a danger of catching diseases from using public toilets, and the public has recently become more aware of this danger. Thus public restrooms often supply paper toilet seat covers for users to place on the toilet seats to prevent their buttocks and legs from contacting such seats.

Heretofore, inventors designed several types of toilet seat covers. U.S. Pat. No. 3,753,262 to Watsky (1973) discloses a disposable toilet seat cover with a large number of radial slits which form a corresponding number of triangular tabs that hang down into the toilet bowl. These tabs cover the inner periphery of the toilet seat to prevent it from contacting the user's body. U.S. Pat. No. 4,745,640 to Nelson (1988) shows a disposable toilet seat cover with an effective microbiocidal shield, or barrier, between the user and the toilet seat. While they form an effective shield between the user and the seat, these covers have a serious disadvantage: they allow water from the toilet to splash upwardly when the user's stools drop into such water. Such a splash often contacts the user's buttocks, an annoying, uncomfortable, and sometimes disease-spreading occurrence. Even in household toilets, such a splash contaminates the toilet's surrounding area, causing soiling and concomitant unpleasant cleaning problems.

Another toilet seat cover with an elongated center flap is shown in U.S. Pat. No. 1,835,787 to Knisely (1931). Knisely's seat cover, due to its method of a folding, has a center flap which can be elongated to drop down to the toilet water so that the seat cover can be flushed away automatically. However, this flap neither suppresses splashing nor blocks the splash from the contacting the user in case one occurs.

One toilet seat cover which also prevents splashing is shown in U.S. Pat. No. 1,236,789 to White (1917). White's cover is a single piece of pliable material formed into a spirally cut strip and adapted to hang down below the seat. While this strip may suppress splashing, it is not possible to make it of biodegradable material which can be flushed away easily and at the same time to be strong enough to support the weight of the stools to prevent a splash. Another disadvantage is that the spirally cut strip is not strong enough to block or slow down the falling stools and to provide a large enough barrier to block the splash completely in case one occurs.

Another toilet seat cover designed to prevent splashing is shown in U.S. Pat. No. 1,673,622 to Engalitcheff (1928). Engalitcheff's cover consists of several side members which form the seat covering portion when they are glued together. They are also connected to front and rear arms with a bigger central portion at their ends. When this seat cover is used, the arms and the central portion will drop below the toilet seat to support the falling stools to avoid splashing. While this cover may suppress splashing, it has several serious disadvantages: this cover is not economically practical to manufacture because it requires gluing the side members together. Also, significant portions of paper must be wasted during manufacturing due to its shape. Another disadvantage is that the feces become malodorous since they are supported by the central portion and thus are exposed in the air. Moreover, the weight of the feces on the central portion has a tendency to pull the seat covering portion to misalign with the toilet seat.

Several other splash-suppressing devices have been proposed. For example, U.S. Pat. No. 4,010,497 to Menter (1977) discloses a coated paper shaped to conform with the surface area of the toilet water. The user places the coated paper so that it floats on the water so as to eliminate splashing. However, it is difficult to provide paper which is biodegradable so that it won't clog the sewage disposal system, yet is stiff enough to block stools from falling fast enough to create a splash.

Some other covers could potentially eliminate the splash of toilet water, even though they were not designed for this purpose. For example, U.S. Pat. No. 2,840,826 to Ebbesen and Johnson (1956) discloses a flexible strip of disposable material which is suspended within the toilet bowl for the purpose of collecting stools for examinations. While these devices prevent splashing because the stools are collected by the strip, they also prevent the stools from reaching the toilet bowl so that they can be flushed away in a normal manner. Moreover, the feces become malodorous when they are exposed to the air. In addition, such cover don't prevent body contact with the toilet seat.

U.S. Pat. No. 3,588,921 to Nagel (1971) shows a combination seat cover and stool specimen collector. However, although this device prevents splashing, it also allows the air induced odors to form and does not allow the excrement to be flushed away. Therefore, such seat covers do not provide a practical solution to the splashing problem.

OBJECTS AND ADVANTAGES

Accordingly, several objects and advantages of the present inventions are:

(a) to provide a disposable toilet seat cover with better shielding between the user's body and the toilet seat, (b) to provide a splash-suppressing device which reduces splashing of toilet water caused by the drop of stools into such water, and (c) to provide a splash-suppressing device which blocks splashes, when and if they occur, from contacting the human body, or contaminating the toilet.

Other objects and advantages are:

(d) to provide a splash-suppressing device which deflects urine from contacting and contaminating the toilet's surrounding area, and prevents a user's penis from contacting the toilet seat, and (e) to provide a splash-suppressing toilet seat cover which utilizes but one sheet of paper or other biodegradable folding material with advantages (a) to (d) above.

Further objects and advantages are to provide a combination disposable toilet seat cover and a splash-suppressing device which can effectively prevent human excreta from accumulating on the inside edge of a toilet seat, which can be used easily and conveniently in both public and household toilets, which is simple to use and inexpensive to manufacture, which is compatible with existing toilet seat cover dispensers used in most public restrooms today, which can be placed on various types of toilet seats with round or elliptical shapes, open loops, closed loops, etc, and which can be fitted in self-carry packages for household applications or for travellers. Still further objects and advantages will become apparent from a consideration of the ensuing description and drawings.

DRAWING FIGURES

Reference Numerals in Drawings

Figure 1:
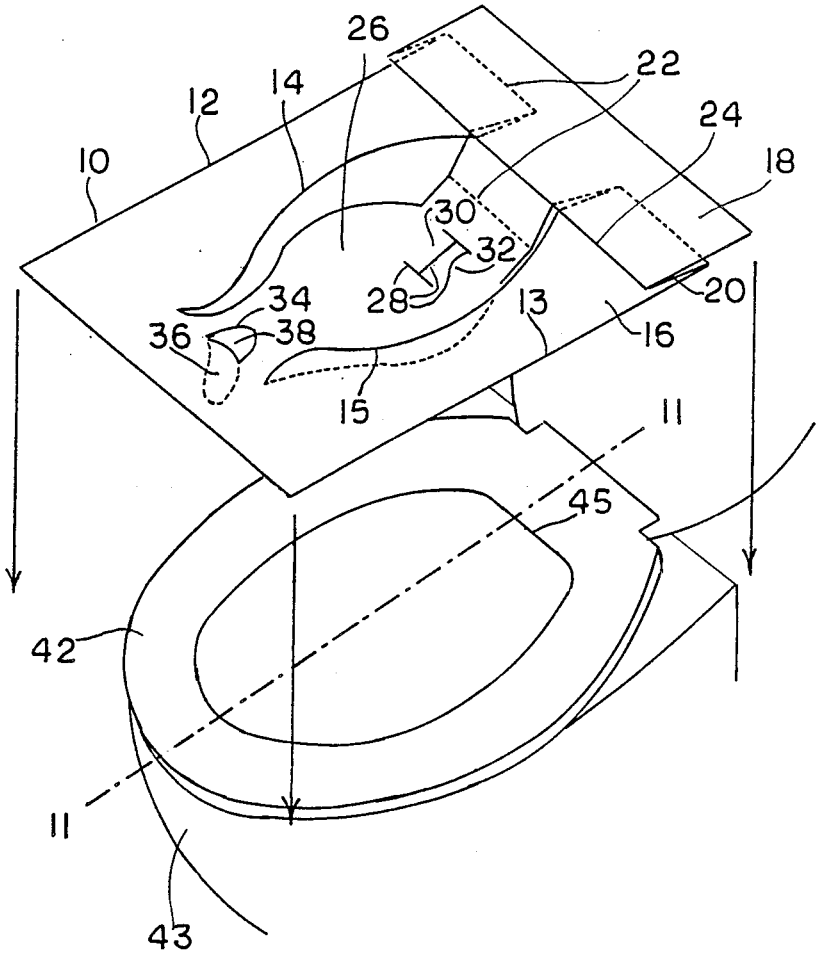
FIG. 1 is a perspective view of a toilet seat cover according to a preferred embodiment of the invention in position for placement on a toilet seat.

10 disposable splash-suppressing toilet seat cover
12 left outside perimeter
13 right outside perimeter
14 left inside perimeter
15 right inside perimeter
16 seat-covering portion
18 top layer
20 second layer
22 fold line
24 fold line
26 splash-preventing center section
28 feces-retarding flap cut line
30 left feces-retarding flap
32 right feces-retarding flap
34 urine-retarding flap cut line
36 urine-retarding flap
38 urine opening
40 human buttocks
42 toilet seat
43 toilet's front side
44 toilet water's surface
45 toilet seat's rear inside edge
46 penis
50 alternative cover
52 front outside perimeter
54 front inside perimeter
56 rear outside perimeter
58 rear inside perimeter
60 seat-covering portion
62 left top layer
64 right top layer
66 left center layer
68 right center layer
70 fold line
72 fold line
74 fold line
76 fold line
78 splash-preventing center section
80 feces-retarding flap cut line
82 feces-retarding flap

DESCRIPTION

Figure 2:
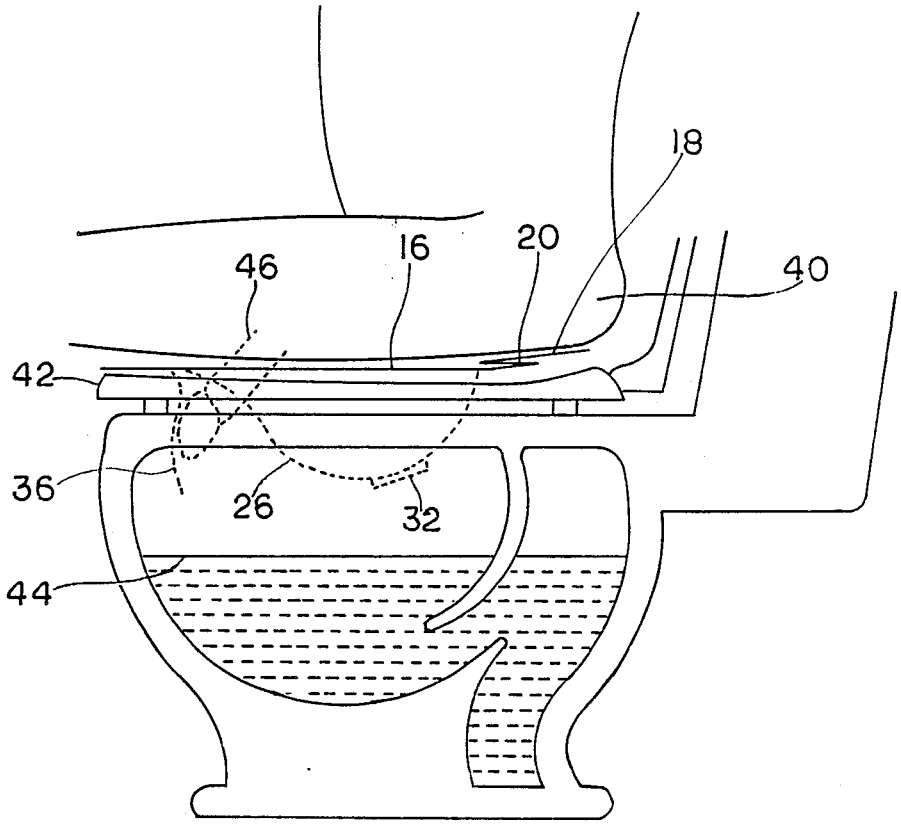
FIG. 2 is a cross sectional view taken on line II—II of FIG. 1 after the cover is placed on and aligned with the toilet seat.
Figure 3:
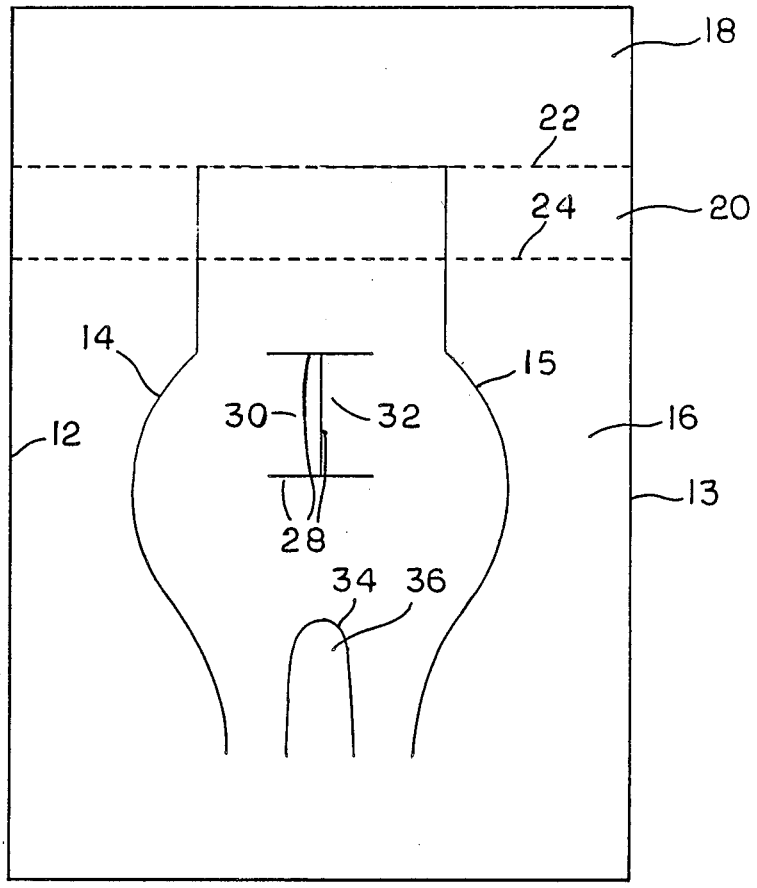
FIG. 3 is a plan view of the cover of FIG. 1 in a flat position.

FIGS. 1 to 3 -- Cover with Single, Transverse Fold Set

FIG. 1 shows a perspective view of a disposable splash-suppressing toilet seat cover 10 with a single, transverse fold set in accordance with a presently preferred embodiment of my invention. Cover 10 includes an annular seat-covering portion 16 having a left outside and inside perimeters 12 and 14, right outside and inside perimeters 13 and 15, and a top layer flap 18. Covering portion 16 is formed by cuts and folds to define a toilet seat shape with sufficient area between its outside and inside perimeters, and enough width from the top layer flap 18, to cover the entire seat. Its purpose is to prevent contact between human buttocks 40 and seat 42, as shown in FIG. 2.

The seat cover includes a generally U-shaped cut along line 34 to form a urine-retarding flap 36 which, when bent away, forms a urine opening 38 which is shaped like a half ellipse. Opening 38 is about 5 cm. (2 in.) wide (measured left-to-right) and 7.5 cm. (3 in.) long (front-to-rear).

FIG. 1 and 2 shows how urine opening 38 allows a male user's penis 46 to be placed therethrough to release urine into the toilet. The urine will contact flap 36 and drip onto water's surface 44 without contaminating the toilet's surrounding area.

FIG. 3 shows a plan view of cover 10 unfolded to a flat position. A splash-preventing center section 26 is formed by cuts along left inside perimeter 14 and right inside perimeter 15, and folds along lines 22 and 24 which form a rear transverse fold set. Fold line 22 is made parallel to and about 10 cm. (4 in.) from the cover's rear edge and line 24 is parallel to and about 3.5 cm. (1.4 in.) from line 22. Fold lines 22 and 24 are made in opposite directions so as to form a zig-zag shape. As seen in FIG. 2, the zig-zag portion has three layers, including a center layer or section 20, an end or top section 18, and a bottom or main section 16.

When cover 10 is disposed on and aligned with seat 42 and if seat 42 is viewed in the direction as shown in FIG. 2, inner section 26 of cover 10 will drop and hang down below the outer, annular portion in a shape of a curve. The width of layer 20 (between fold lines 22 and 24) is selected so that the lowest part of section 26 will hang above surface 44 of the toilet water, as illustrated in FIG. 2.

As illustrated in FIGS. 1 and 3, center portion 26 is cut along line 28 to form left and right feces-retarding flaps 30 and 32. The border common to flaps 30 and 32 is about 6.5 cm. (2.5 in.) long and each flap is about 3 cm. (1.2 in.) wide.

Seat cover 10 can be made of thin paper similar to that currently used for existing toilet seat covers. The side of the paper which customarily faces upward and contacts the user should be calendered or coated smoothly to avoid adhesion problem.

Figure 4:
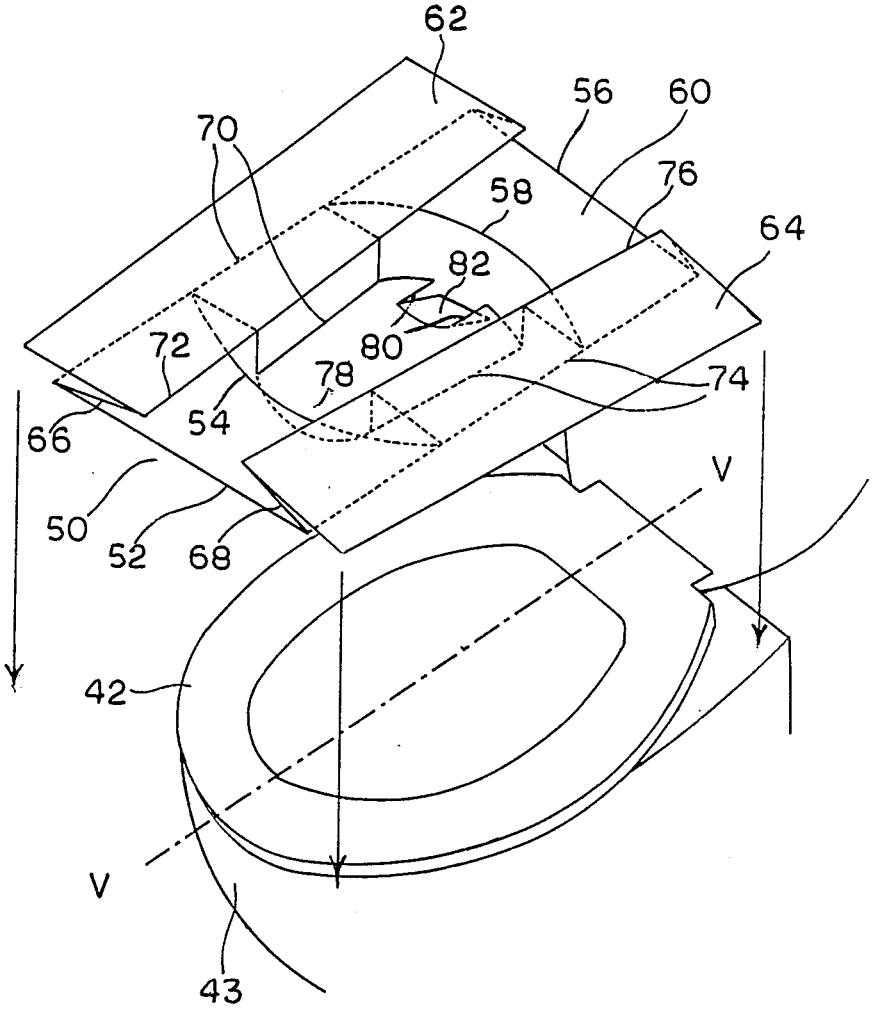
FIG. 4 is a perspective view of a toilet seat cover according to a second embodiment of the invention in position for placement on a toilet seat.
Figure 5:
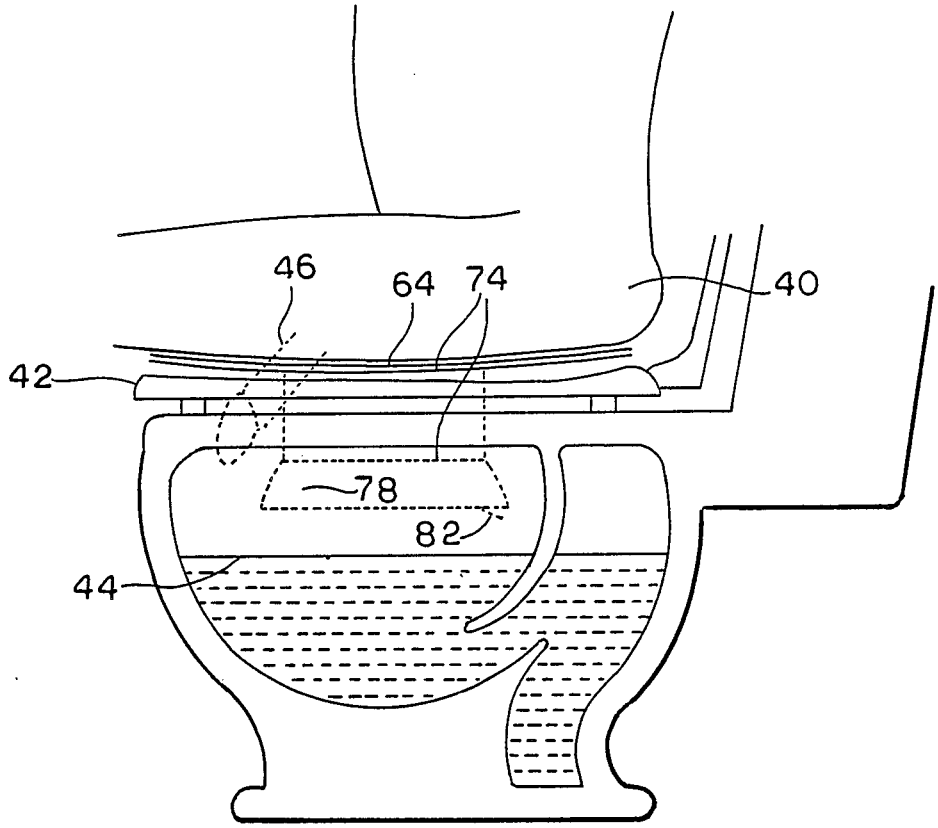
FIG. 5 is a cross sectional view taken on line V—V of FIG. 4 after the cover is placed on and aligned with the toilet seat.
Figure 6:
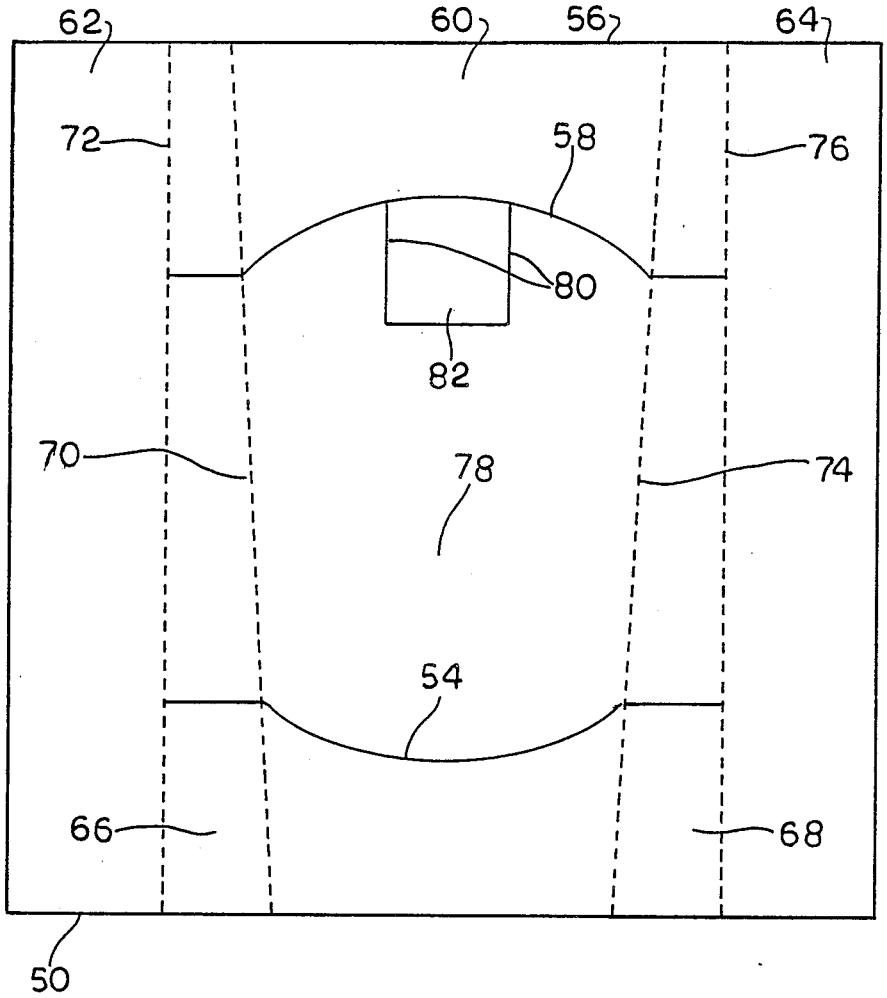
FIG. 6 is a plan view of the cover of FIG. 4 in a flat position.

Description -- FIGS. 4 to 6 -- Cover with Double Longitudinal Fold Sets

FIGS. 4 to 6 shows a disposable splash-suppressing toilet seat cover 50 according to a second embodiment of my invention. This embodiment differs from the first embodiment in how the paper is cut and folded. Specifically, it is a cover with double longitudinal fold set. Their differences will be described in more detail later.

FIG. 4 shows a perspective view of a cover 50 according to the second embodiment. It includes a seat-covering or annular portion 60 formed by cuts and folds to define a toilet seat shape. It has sufficient area between its front outside and inside perimeters 52 and 54, its rear outside and inside perimeters 56 and 58, and enough width from left and right top layers 62 and 64 to cover the seat. As with the first embodiment, its purpose is to prevent contact between human buttocks 40 and seat 42, as shown in FIG. 5.

FIG. 5 shows a male user's penis 46 is placed therethrough to release urine onto water's surface 44.

FIG. 6 shows a plan view of cover 50 in a flat position. A splash-preventing center section 78 is formed by cuts along front and rear inside perimeters 54 and 58, and folds along lines 70, 72, 74, and 76 so as to form two longitudinal fold sets.

Fold line 72 is made parallel to and about 9 cm. (3.5 in.) from the cover's left edge and line 70 is oriented at about 10degrees and about 4.5 cm. (1.8 in.) from line 72 so as to match the shape of seat 42. As in the embodiment of FIGS. 1 to 3, folds 70 and 72 are made in opposite directions so as to form a zig-zag shape. As seen in FIG. 4, the zig-zag portion has three layers, including a left center layer or section 66, a left top layer 62, and a bottom or main section 60.

Fold line 76 is made parallel to and about 9 cm. (3.5 in.) from the cover's right edge and line 74 is oriented at about 10 degrees and about 4.5 cm. (1.8 in.) from line 76 so as to match the shape of seat 42. Again, lines 74 and 76 are formed in opposite directions so as to form a zig-zag shape. As seen in FIG. 4, the zig-zag portion has three layers, including a right center layer or section 68, a right top layer 64, and a bottom or main section 60.

If cover 50 is disposed on and aligned with seat 42 and if seat 42 is viewed in the direction as shown in FIG. 5, inner section 78 of cover 50 will drop and hang down below the outer, annular portion in a shape of a curve. The width of layers 66 and 68 should be adjusted so that the lowest part of section 78 will hang above surface 44 of the toilet water, as illustrated in FIG. 5.

As illustrated in FIGS. 4 and 5, a feces-retarding flap 82 can be formed by cutting along line 80.

Cover 50 differs from that of cover 10 illustrated in (FIGS. 1 to 3) in the following areas:

(1) Cover 50 has four fold lines (70, 72, 74, and 76) and two longitudinal, side fold sets, whereas cover 10 has only two fold lines (22 and 24) and one transverse, rear fold set.

(2) Fold lines 70, 72, 74, and 76 in cover 50 run almost parallel to line V—V (FIG. 4), whereas fold lines 22, 24 in toilet seat cover 10 run almost perpendicular to line II—II (FIG. 1).

(3) In order that cover 50 will conform with seat 42, fold lines 70 and 74 are formed at an acute angle to fold lines 72 and 76, respectively, as illustrated in FIG. 6. In cover 10, on the other hand, fold line 22 should be parallel to fold line 24, as illustrated in FIG. 3.

(4) Due to the structure of center section 78 of cover 50 (FIG. 5), a urine opening is not required. However, urine opening 38 is required for center section 26 of cover 10, as illustrated in FIG. 1 and 2.

Operation -- FIGS. 1 to 3 -- Cover with Single, Transverse Fold Set

Referring to FIGS. 1 and 2, when cover 10 is disposed on and aligned with seat 42 and viewed in the direction shown in FIG. 2, inner section 26 of cover 10 will drop and hang down below the outer, annular portion in a shape of a curve. A zig-zag or fan-fold is provided at one end of the cover; this fan-fold extends across the center portion and its adjacent side portions. By unfolding the fan-folds of the center portion and leaving the fan-folds of adjacent portions folded, the center portion can effectively be made longer so that it will hang down below the side portions, as shown.

The width of layer 20 (between fold lines 22 and 24) is adjusted so that the lowest part of section 26 will hang above surface 44 of the toilet water, as illustrated in FIG. 2.

As stools fall from buttocks 40, they will fall onto section 26 where their speed of descent will be substantially retarded. Then they will roll down to and through the gap formed by cut line 28 between flaps 30 and 32, whereafter they will fall onto water surface 44. Their friction with flaps 30 and 32 will slow down their speed so as further to reduce the chance of creating a splash.

For larger or heavier stools, a mild splash might occur, even though their speed slowed down by friction. However, section 26 will block the splash, which travels upward, from contacting buttocks 40 or the toilet's surrounding area. Section 26 also prevents any excreta residue left on buttocks 40 from contacting the seat's rear inside edge 45, thereby avoiding soiling the toilet seat.

As shown in FIGS. 1 and 2, as urine leaves penis 46, it will contact urine-retarding flap 36 and drip onto the water's surface 44 without contaminating the toilet's surrounding area. Flap 36 also prevents penis 46 from contacting seat cover 42. Female's urine will fall onto section 26 and drip through the gap between flaps 30 and 32 onto surface 44, without contaminating the toilet's surrounding area.

Thus my toilet seat cover will provide the usual shielding function between a user's buttocks and a toilet seat, thereby effecting a sanitary arrangement for public restrooms. At the same time, it will also prevent the annoying, potentially harmful splashes which occur when stools fall into the toilet water. It does this by center section 26, which slows down the stools' falling speed to reduce the chance of creating a splash, and block the splash from contacting the users when it occurs.

The toilet seat cover can be packaged for user-carrying just as conventional covers are now packaged. It can easily be folded in quarters, eighths, etc. and kept in a compact box about 20 cm. (8 in.) by 8 cm. (3 in) which can be carried conveniently in one's purse, briefcase, etc. Also it can cover and be used in toilet seats with any size or shapes in use today, including round or elliptical shapes, open loops, closed loops, etc. Further, it can be carried in and dispensed from usual toilet-stall-wall mounted dispensers since it is of the same size as conventional seat covers.

Operation -- FIGS. 4 to 6 -- Cover with Double Longitudinal Fold Sets

The operation of the second embodiment of FIGS. 4 and 5 can easily be understood from these FIGS.

As stools drop from buttocks 40, they will fall onto section 78 and contact feces-retarding flap 82 before they hit water surface 44. Such contact, plus their friction with flap 82, will slow down their speed so as to reduce the chance of creating a splash.

As before, for larger or heavier stools, a mild splash might occur, even though their speed slowed down by friction. However, section 78 will block the splash from contacting buttocks 40 or the toilet's surrounding area.

As urine leaves penis 46, it will fall freely onto water's surface 44. In this alternative design, section 78 does not retard or block urine from contacting the toilet's surrounding area, and does not prevent penis 46 from contacting toilet seat 42.

Summary, Ramifications, and Scope

Accordingly, the reader will see that I have provided a disposable splash-suppressing toilet seat cover which can be used as a combination disposable toilet seat cover and a splash-suppressing device. It can effectively prevent soiling the inside edge of a toilet seat, and can be used easily and conveniently in both public and household toilets. It is simple to use and inexpensive to manufacture; it is compatible with existing toilet seat cover dispensers used in most public restrooms today; it can be placed on various types of toilet seats with round or elliptical shapes, open loops, closed loops, etc., and can also be fitted in self-carry packages for household applications or for travellers. Furthermore, it has the following additional advantages:

(a) It provides a disposable toilet seat cover with better shielding for improved prevention of the user's body from contacting the toilet seat.

(b) It provides a splash-suppressing device which reduces splashing of toilet water caused by the drop of stools into such water.

(c) It provides a splash-suppressing device which blocks splashes, when and if they occur, from contacting the human body, or contaminating the toilet.

(d) It provides a splash-suppressing device which deflects urine from contacting and contaminating the toilet's surrounding area, and prevents a user's penis from contacting the toilet seat.

(e) It provides a splash-suppressing toilet seat cover which utilizes but one piece of paper or other biodegradable folding material with advantages (a) to (d) above.

Although the above description contains many specificities, these should not be construed as limiting the scope of the invention but as merely providing illustrations of some of the presently preferred embodiments of this invention. For example, the toilet seat cover and the splash-suppressing device can be constructed from separate pieces of material which are thereafter glued, taped, or hinged together instead of being made by cutting and folding; the feces-retarding flap can be designed in many other shapes and configurations, such as a single-flap configuration. The splash-suppressing effect can still be achieved even without the provision of the feces-retarding flap, etc.

Also, the toilet seat cover should not be limited to a particular size as the seat covering area can be adjusted to fit differently-sized toilet seats. Other materials can be used to make the toilet seat cover, so long as they are foldable and biodegradable.

Thus the scope of the invention should be determined by the appended claims and their legal equivalents, rather than by the examples given.

I claim:

1. A toilet seat cover for a toilet having a bowl containing water at a predetermined level, said cover comprising:

a sheet of disposable, flexible material having a size, when flat, sufficient to cover a toilet seat of a predetermined size, said sheet having, in its plan view when flat, a continuous, integral, joint-and-seam-free annular perimeter portion and an inner portion surrounded by said annular perimeter portion, said inner portion being elongated and having opposite ends integrally and continuously attached to said annular portion so as to provide an integral bridge across said annular portion, said inner portion having side edges, between said opposite ends, which are free of said annular portion, means for allowing said inner portion to drop below said annular portion, said means comprising a plurality of folds extending generally transverse to the direction of elongation of said inner portion, said folds extending across said inner portion and said annular portion, such that when said annular portion is placed upon a toilet seat, said inner portion will unfold and drop below said seat and into said toilet above said predetermined level and said annular portion will cover said seat, wherein when said toilet seat cover is placed upon a toilet seat, it can be rapidly deployed and said inner portion will automatically drop below said seat to provide a fecal splash suppressor, and said cover can be made without gluing.

2. The cover of claim 1 wherein said inner portion includes an opening for allowing stools to pass therethrough.

3. The cover of claim 1 wherein said inner portion includes a first opening in the center thereof for allowing stools to pass therethrough and a second opening adjacent one end of said inner portion for allowing urine to pass therethrough, said first opening comprising means for retarding the speed of said stools so that they have less tendency to splash water in said toilet.

4. The cover of claim 1 wherein said means further includes a second plurality of folds, one pair at each end of said sheet, the folds of each pair being oriented at an acute angle to each other.

5. The cover of claim 4 wherein said inner portion includes an opening for allowing stools to pass therethrough, said opening comprising means for retarding the speed of said stools so that they have less tendency to splash water in said toilet.

6. The cover of claim 5 wherein said opening is adjacent a side edge of said inner portion.

7. A toilet seat cover for a toilet having a bowl containing water at a predetermined level, said cover comprising:

a sheet of disposable, flexible material having a size, when flat, sufficient to cover a toilet seat of a predetermined size, said sheet having, in its plan view when flat, a continuous, integral, joint-and seam-free annular perimeter portion and an inner portion surrounded by said annular perimeter portion, said inner portion being elongated and having opposite ends integrally and continuously attached to said annular portion so as to provide an integral bridge across said annular portion, said inner portion having side edges, between said opposite ends, which are free of said annular portion, means for allowing said inner portion to drop below said annular portion, said means comprising a plurality of folds extending generally transverse to the direction of elongation of said inner portion, said folds being at one end of said sheet and extending across said inner portion and said annular portion, such that when said annular portion is placed upon a toilet seat, said inner portion will unfold and drop below said seat and into said toilet, above said predetermined level, wherein when said toilet seat cover is placed upon a toilet seat, it can be rapidly deployed and said inner portion will automatically drop below said seat to provide a fecal splash suppressor, and said cover can be made without gluing.

8. The cover of claim 7 wherein said inner portion includes an opening for allowing stools to pass therethrough.

9. The cover of claim 7 wherein said inner portion includes a first opening in the center thereof for allowing stools to pass therethrough and a second opening adjacent one end of said inner portion for allowing urine to pass therethrough, said first opening comprising means for retarding the speed of said stools so that they have less tendency to splash water in said toilet.

10. The cover of claim 7 wherein said means further includes a second pair of folds, one pair at each end of said sheet, the folds of each pair being oriented at an acute angle to each other.

11. The cover of claim 10 wherein said inner portion includes an opening for allowing stools to pass therethrough, said opening comprising means for retarding the speed of said stools so that they have less tendency to splash water in said toilet.

12. The cover of claim 11 wherein said opening is adjacent a side edge of said inner portion.

13. A toilet seat cover for a toilet having a bowl containing water at a predetermined level, said cover comprising:

a sheet of disposable, flexible material having a size, when flat, sufficient to cover a toilet seat of a predetermined size, said sheet having, in its plan view when flat, a continuous, integral, joint-and seam-free annular perimeter portion and an inner portion surrounded by said annular perimeter portion, said inner portion being elongated and having opposite ends integrally and continuously attached to said annular portion so as to provide an integral bridge across said annular portion, said inner portion having side edges, between said opposite ends, which are free of said annular portion, means for allowing said inner portion to drop below said annular portion, said means comprising a plurality of folds extending generally transverse to the direction of elongation of said inner portion, said folds being at one end of said sheet, extending across said inner portion and said annular portion, and being arranged in a zig-zag manner so that said sheet has a portion comprising three sequential, parallel adjacent layers, said portion being bounded by said folds, such that when said annular portion is placed upon a toilet seat, said inner portion will unfold and drop below said seat and into said toilet above said predetermined level, whereby when said toilet seat cover is placed upon a toilet seat, it can be rapidly deployed and said inner portion will automatically drop below said seat to provide a fecal splash suppressor, and said cover can be made without gluing.

14. The cover of claim 13 wherein said inner portion includes an opening for allowing stools to pass therethrough.

15. The cover of claim 13 wherein said inner portion includes a first opening in the center thereof for allowing stools to pass therethrough and a second opening adjacent one end of said inner portion for allowing urine to pass therethrough, said first opening comprising means for retarding the speed of said stools so that they have less tendency to splash water in said toilet.

16. The cover of claim 13 wherein said means further includes a second plurality of folds, one pair at each end of said sheet, the folds of each pair being oriented at an acute angle to each other.

17. The cover of claim 16 wherein said inner portion includes an opening for allowing stools to pass therethrough, said opening comprising means for retarding the speed of said stools so that they have less tendency to splash water in said toilet.

18. The cover of claim 17 wherein said opening is adjacent a side edge of said inner portion.

19. The cover of claim 13 wherein said sheet of material is made of a single sheet of biodegradable paper.

* * * * *